US005701789A

United States Patent [19]

Okonski

[11] Patent Number: 5,701,789

[45] Date of Patent: Dec. 30, 1997

[54] WASTE REPELLENT DIE STRUCTURE

[75] Inventor: Frank Okonski, Harwood Heights, Ill.

[73] Assignee: Best Cutting Die Company, Skokie, Ill.

[21] Appl. No.: 419,185

[22] Filed: Apr. 10, 1995

[51] Int. Cl.[6] ..... B26D 7/18

[52] U.S. Cl. ..... 83/13; 83/98; 83/117; 83/128; 83/698.42

[58] Field of Search ..... 83/98, 100, 123, 83/128, 346, 698.42, 134, 136, 140, 143, 117, 118, 698.21, 653, 13

[56] References Cited

U.S. PATENT DOCUMENTS

| | | | |
|---|---|---|---|
| 623,862 | 4/1899 | Armstrong . | |
| 2,088,118 | 7/1937 | Schillo | 164/28 |
| 2,302,855 | 11/1942 | Hallman | 164/28 |
| 2,679,291 | 5/1954 | Collinson | 83/140 |
| 3,186,274 | 6/1965 | Winkler et al. | 83/103 |
| 3,209,630 | 10/1965 | McCartan . | |
| 3,850,059 | 11/1974 | Kang . | |
| 3,946,627 | 3/1976 | Hofmann | 883/117 |
| 3,965,786 | 6/1976 | D'Luhy . | |
| 4,499,802 | 2/1985 | Simpson . | |
| 4,537,588 | 8/1985 | Ehlsheid et al. . | |
| 4,823,659 | 4/1989 | Falasconi . | |
| 4,896,573 | 1/1990 | Kapolnek | 83/117 |
| 5,111,725 | 5/1992 | Simpson et al. | 83/117 |
| 5,178,051 | 1/1993 | Smith et al. . | |

FOREIGN PATENT DOCUMENTS 741205 5/1943 Germany .

*Primary Examiner*—Kenneth E. Peterson
*Attorney, Agent, or Firm*—Sitrick & Sitrick

[57] ABSTRACT

A cutting die system having an improved waste or scrap removal system is provided. Curved edge patterns are cut into the cutting die plate within the parameters of the cutting edge. These partial cutouts having curved edges are provided so that when the cutting die is mounted to the die cylinder, the bending of the cutting die to fit the curvature of the die cylinder causes the cut out shape to pop up. The direction of the pop-up cut out shape is complementary to the relative direction of rotation of the cutting die and the height of the projections remains below the cutting edge height. When the pop-up cut out shape comes in contact with the waste or scrap material, the waste or scrap material is pushed outward and away from the direction of the die cylinder.

14 Claims, 3 Drawing Sheets

WASTE REPELLENT DIE STRUCTURE

FIELD OF THE INVENTION

The present invention relates generally to cutting dies, and more particularly to a scrap material removal method and system for use in cutting patterns from material.

BACKGROUND OF THE INVENTION

Impressing systems comprising die plates mounted on a die holder are utilized to process and finish predetermined patterns in sheet-like material typically found in web or blank form. Typical die plates include cutting plates and the like. The cutting die plates are attached to the die holder, sometimes called a die cylinder or drum, which brings the plate into successive contact with the web or blank. Die holders include non-magnetic holders where the die is physically mounted (i.e., screwed in) on the holder, and magnetic holders having magnetic materials on the holder surface to magnetically hold a metal die in place thereon (without the need for drilling special holes and screwing the die into the holder). The web or blank is pressed between the die cylinder and widia bar or anvil. With cutting plates, the cutting element of the cutting die plate intimately contacts the web or blank during this operation, cutting the predetermined pattern from the web or blank which then advances on a conveyor system. In the past, with cutting die plates, as the die cuts material patterns from material, such as windows out of paper envelopes, the scrap material cut, such as chips of paper, did not always completely disengage from the window being cut on the original material. Even if the scrap material did disengage from the original material, there was still a likelihood that the scrap material would be left on the cutting die plate near the edges of the pattern being cut. This residual scrap material which was left on the original material, or on the cutting die plate, caused the cutting machinery to jam, which resulted in down time, breakage of tooling, waste of material, and slowing down of machine operation to compensate for the residual scrap material buildup.

In the past various methods have been implemented to solve the problem of buildup of residual scrap material. Spring loaded mechanical devices were often employed. For example, U.S. Pat. No. 3,946,627 to Hofmann describes a specific embodiment of a rotary apparatus for punching holes into corrugated material. The method of removal of the residual scrap material teaches the use of a spring loaded ejector having a telescoping, outwardly spring-loaded shell. As the springs in the spring-loaded shell lost their resiliency, the telescoping, outwardly spring-loaded shell lost the ability to push the residual corrugated material completely away from the rotary apparatus. The springs would have to be replaced, causing waste of material and costly downtime.

Pressurized air was also typically used to blow the residual scrap material, such as paper chips, away from the cutting die plate. Air was blown through the die cylinder so as to blow the chips off of the cutting die plate. Use of a large vacuum external to the cutting die plate, either alone or in conjunction with the pressurized air, pulled the residual scrap material away from the cutting die plate and delivered it into a waste bin. With some smaller cutting dies, a vacuum system was used to pull waste through the cutting die plate and die cylinder and deliver it into the waste bin.

In the past, use of air, pressurized or vacuum; to solve the problem of residual scrap material suffered several disadvantages. If the scrap material is still damp (such as having been printed and not fully dried) then the scrap material, such as chips of paper, can become wedged into the die, and the air pressure typically used to remove the residual scrap material will not be sufficient to blow the chips off of the cutting die plate. Moreover, the vacuum used to pull the residual scrap material away and deliver it to a waste bin may not be sufficient. Further, there is a tendency for the residual scrap material to be retained around the edges of the cutting surface, thereby hampering the smooth operation of the cutting die. If the vacuum is increased to overcome the drag from the damp scrap material, smaller cutting dies can be pulled from the die cylinder.

U.S. Pat. No. 2,302,855 to Hallman taught combining a spring-loaded mechanical device mounted onto the die cylinder and an air pressure ejecting means. Springs first forced the residual scrap material away from the cutting die plate and a suction apparatus then removed it by suction. This method of residual scrap removal is susceptible to failure from both degradation of the moving mechanical pans and from the deficiencies inherent in the pressurized air removal systems.

OBJECT AND SUMMARY OF THE INVENTION

It is an object of the invention to provide an improved scrap removal system for a cutting tool for cutting patterns in sheet-like material.

It is another object of the invention to provide cutting die systems having an improved method and apparatus for removal of scrap material which functions in an efficient manner.

It is a specific object of the invention to provide a cutting die system having an improved method and apparatus for removal of scrap material which reduces downtime of the cutting die system.

A further object of the invention is to provide an improved method for removal of scrap material which reduces the amount of residual scrap material retained around the edges of the curing surface, thereby fostering the smooth operation of the cutting die.

Another object of the invention is to provide a cutting die system having an improved method and apparatus for removal of scrap material without using external moving mechanical parts.

It is another object of the invention to provide a cutting die system having an improved method and apparatus for removal of scrap material which reduces maintenance on the cutting die system.

Another object of the invention is to provide an improved method for scrap removal which is adaptable for operation with different cutting die systems.

Still another object of the invention is to provide an improved method for material retention and expulsion which is adaptable for operation with different die systems.

A cutting die system with an improved waste or scrap removal is provided. Within the cutting die plate, curved edge pattern are cut. These partial cut outs, having curved edges, bend when the cutting die is mounted to the die cylinder, fitting the curvature of the die cylinder and causing the cut out shape to pop up. The direction of the pop-up cut out shape is complementary to the relative direction of rotation of the cutting die with the height of the projections remaining below the cutting edge height When the pop-up cut out shape comes into contact with the waste or scrap material, the waste or scrap material is pushed outward and away from the direction of the die cylinder.

In another embodiment of the present invention, the pop-up cut out shape is located outside the perimeter of the cutting die pattern, or on the surface of another type of die, for example, an embossing die. In this manner, the pop-up cut out shape is aligned over the air holes for transfer of vacuum and pressurized air which are located on the die cylinder. As the die cylinder turns, a vacuum through the air holes causes the material to be held close to the die cylinder as material is brought into contact with the die pattern. After contact with the die pattern, the vacuum is released and pressurized air typically blown through the air holes to facilitate the release of the material from the die cylinder. The pop-up cut out shapes facilitate the expulsion of the material from the die cylinder and permit the continued use of the pressurized air through the air holes, thereby increasing the efficiency of the material removal from the die cylinder.

These and other features and advantages of the invention will be more readily apparent upon reading the following description of a preferred exemplified embodiment of the invention and upon reference to the accompanying drawings wherein:

While the invention will be described and disclosed in connection with certain illustrated embodiments and procedures, it is not intended to limit the invention to those specific embodiments. Rather, it is intended to cover all such alternative embodiments and modifications as fall within the spirit and scope of the invention.

DETAILED DESCRIPTION OF THE PREFERRED EMBODIMENT

Figure 1:
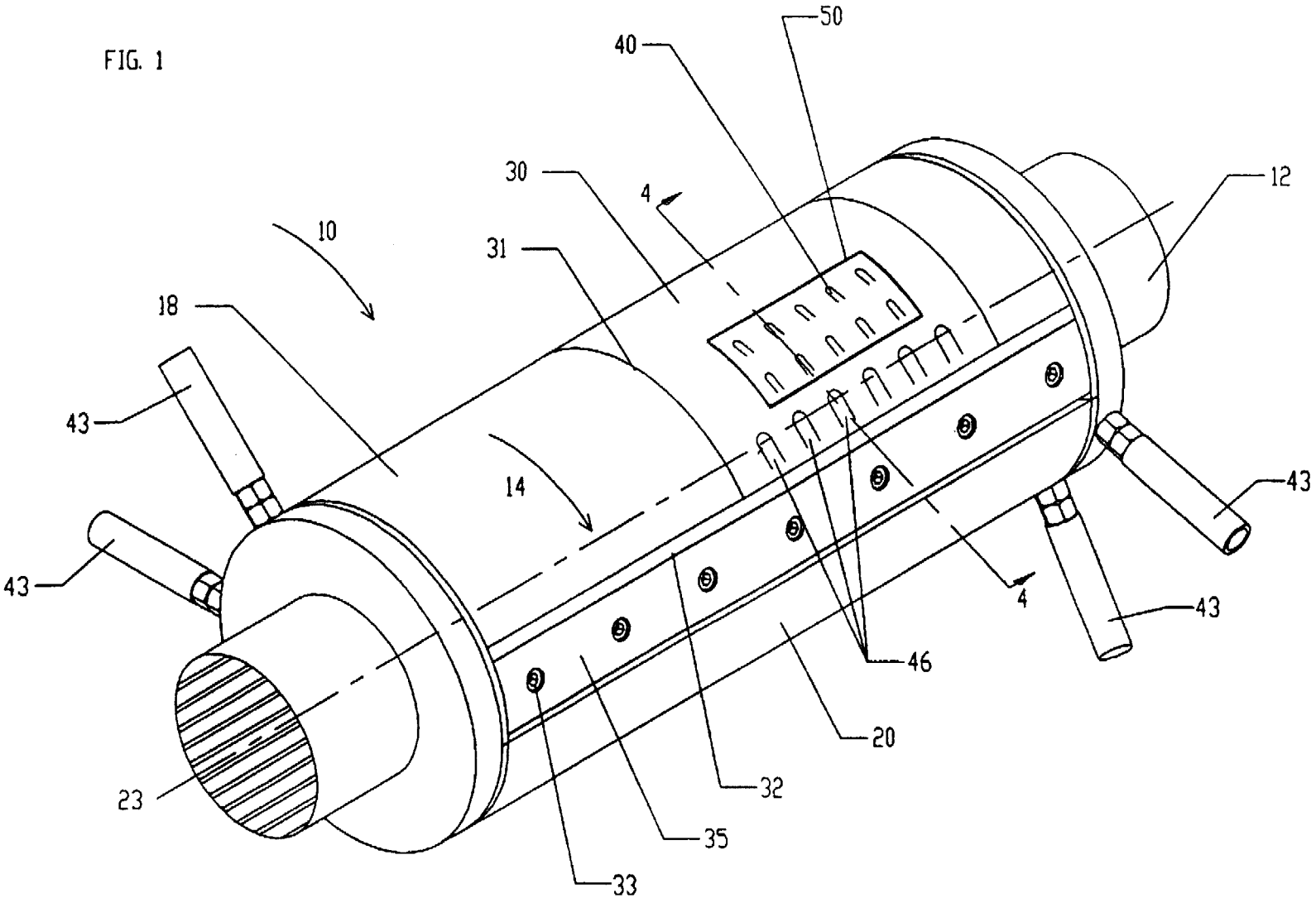
FIG. 1 is a perspective view of a cutting die system having an improved method and apparatus for removal of scrap material in accordance with one embodiment of the present invention.

Referring to the drawings, and more particularly to FIG. 1, one embodiment of a cutting die system 10 for forming patterns in sheet-like material, such as paper and the like, having an improved method and apparatus for removal of scrap material is provided in accordance with the present invention. The system 10 comprises a die holder 20 adapted for retaining a cutting die plate 30 in selected positions around its outer surface 18 as generally shown in FIG. 1.

Referring to FIG. 1, the die holder 20 has a cylindrical shape and is mounted on a drive shaft 12 for rotation so that the cutting die plate 30 engages a different material blank for each rotation of the die holder 20. The die holder 20 has a longitudinal axis 23 generally extending along the axis of the drive shaft 12.

Figure 2:
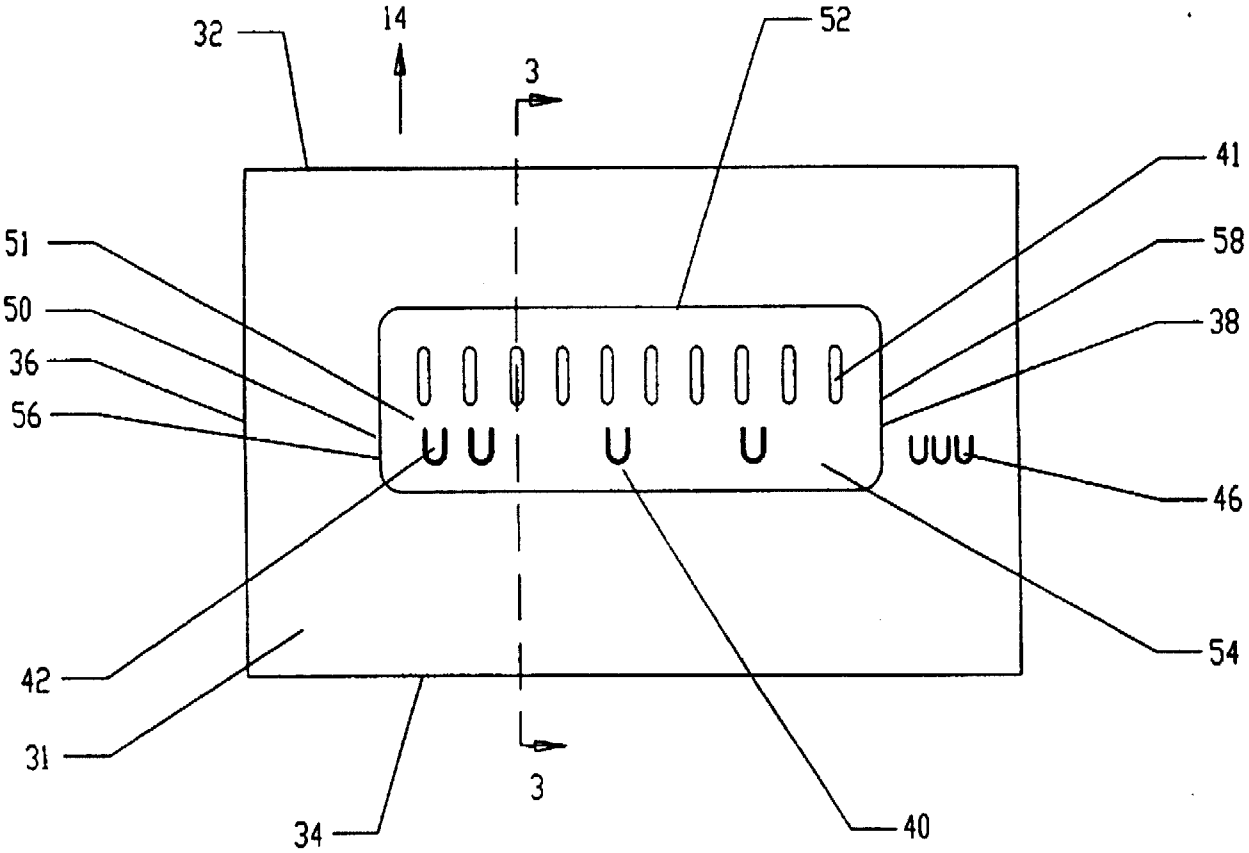
FIG. 2 is a plan view of a cutting die plate having pop up cut out shapes in accordance with one embodiment of the present invention.

As illustrated in FIG. 2, the cutting die plate 30 is a flexible sheet of material, such as metal which has a leading edge 37, a trailing edge 34 and opposing side edges 36, 38. The cutting die plate 30 has a curved surface 31 and a raised pattern surface 50 having a contour corresponding to the outline of the pattern to be formed (e.g., impressed or cut out) in the material blank or web. In the illustrated embodiment, the pattern surface 50 has a rectangular contour to cut a rectangular window panel from an envelope blank defined by a leading pattern surface 52, a trailing pattern surface 54, and opposing side pattern surfaces 56, 58. It will be appreciated that the pattern surface 50 may also have other appropriate shapes and patterns known to those skilled in the art including, for example, a pattern surface adapted to cut the sides of an envelope blank.

The cutting die plate 30 may be manufactured from any suitable flexible magnetic or non-magnetic material including, for example, stainless steel, carbon steel or the like, depending on the type of holder (e.g., magnetic or non-magnetic type) and the means for attaching the cutting die plate to the die holder.

Figure 3:
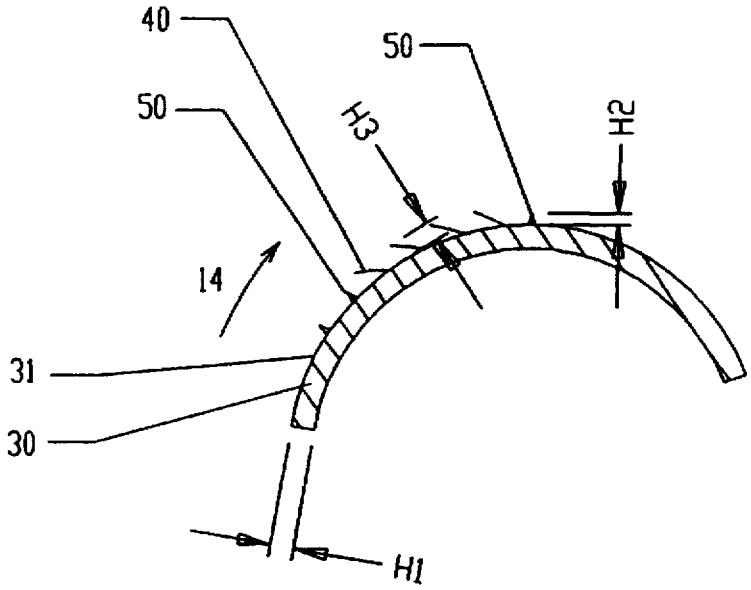
FIG. 3 is a cross section of the cutting die system taken along line 3—3 in FIG. 2.
Figure 4:
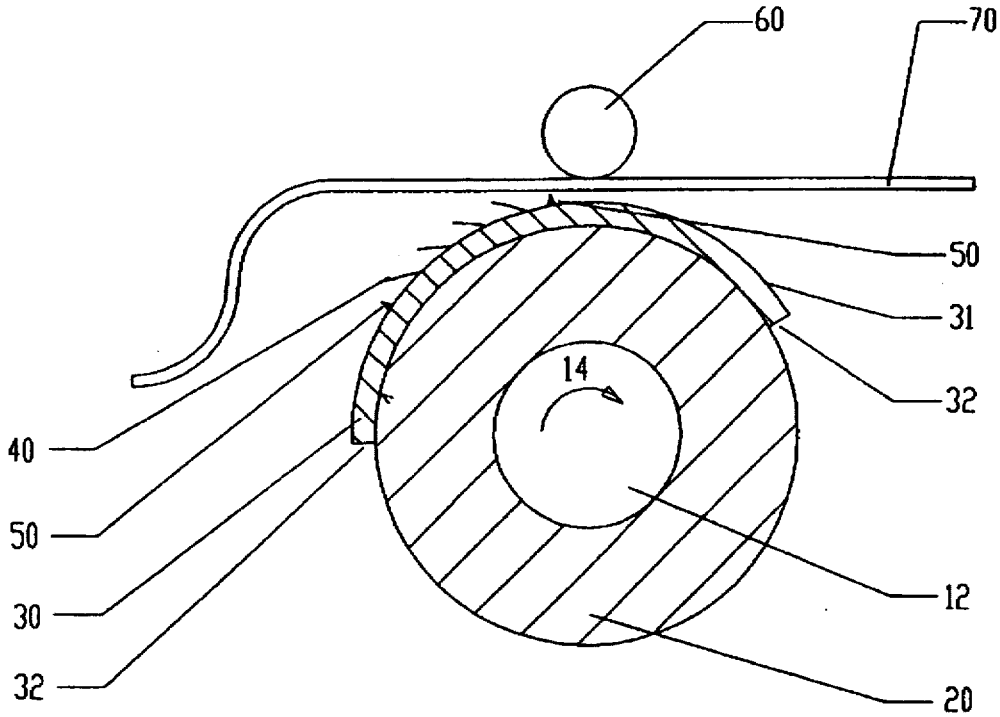
FIG. 4 is a cross section of the cutting die plate in FIG. 1 in use with an anvil and material.

Referring to FIG. 3, the thickness H1 of the plate 30 will typically be from about 0.003–0.060 inches, but may vary depending upon the application. The height H2 at the pattern surface 50 above the surface 31 of the cutting die plate 30 will typically be about 0.003–0.033 inches. Height H3 of the push pattern projections 40 is less than height H2. Other types of cutting die impression plates having different pattern surfaces may have different dimensions H1 and H2 depending upon the application.

The cutting die plate 30 has partial cut-out push pattern projections 40 cut into it on the surface area 51 of the cutting die plate 30 that falls within the boundary of the pattern surface 50. When the cutting die plate 30 is mounted to the die holder 20, the bending of the cutting die plate 30 to fit the curvature of the die holder 20 causes the push pattern projections 40 to bend up and push outward away from the surface 31 of the die holder 20. Operators can also hand bend the push pattern projections up or down.

Referring to FIGS. 1 and 2, alignment of the die plate 30 may be facilitated by the use of mechanical grove 32 which holds a portion of the die plate 30 thereby fixing the die plate 30 into a permanent position on the die holder 20 which, as illustrated in FIG. 1, is held by screws 33 into a clamping bar 35. Tightening the screws 33 compresses the die plate 30 between the mechanical groove 32 and the clamping bar 35 securing the die plate 30 to the die holder 20. Other types of alignment methods which cause the cooperation with the die holder 20 for accurately aligning the cutting die plate are also acceptable.

In one embodiment of the invention, as shown in FIGS. 1 and 2, the push pattern projections 40 are semi-circular or other shapes such as a horseshoe shape, having curved edges 42 provided so that when the cutting die plate 30 is mounted to the die holder 20 the curvature of the die holder 20 causes the curved edges 42 of the semi-circular push pattern projections 40 to bend upward and push out from the cutting die plate 30. Other shape cutouts are also acceptable.

Referring again to FIG. 3, the height H3 of a push pattern projection 40 (above the surface 31 of the cutting die plate 30 varies depending on the application, but at all times remains below the cutting edge height H2. The projection 40 can be manually bent up or down, within these parameters, as desired to adjust the operational conditions.

Referring to FIGS. 1, 2, 3, and 4, the direction of the pop-up push patterns 40 is such that it is complementary to the relative direction of rotation 14 of the die holder 20 and to the anvil 60. Alternatively, a bar (commonly called a widia bar) can be used instead of the anvil 60 to back the blank where the cutting die impresses the blank. When the cutting die plate 30 rotates in its position as mounted on the die holder 20, the cutting pattern 50 cuts the pattern thereby generating scrap material or waste from the web or blank 70. The push pattern projections 40 cause the scrap material or waste from the web or blank to be resiliently pushed away from the system 10 as it is cut to permit for remote waste collection. Because the push pattern projections 40 are oriented in the direction of rotation 14 which is complementary to the direction of rotation of the die holder 20 and the anvil 60, the die holder 20 and the anvil 60 are caused to compress the push patterns 40 during the cutting of the web or blank without damage to the anvil 60 or widia bar.

Referring to FIGS. 1 and 2, in accordance with certain objects of the invention, the surface area 51 is may also be provided with one or more orifices 41. Each of the orifices 41 communicates with one or more corresponding feed tubes 43 which are adapted to feed compressed air from the air deliver system (not shown) to the orifices 41 and into the vicinity of the scrap material formed when the cutting die plate 30 cuts the pattern into the web or blank, so as to blow away the scrap material particles.

In another embodiment of the present invention, shown in FIGS. 1 and 2, the pop-up cut out shapes 46 are located outside the perimeter of the cutting die pattern surface 50, on the cutting die plate 30 or on the surface of another type of die, for example, an embossing die plate. In this manner, the pop-up cut out shapes 46 are aligned over the air orifices (not shown) for transfer of vacuum and pressurized air which are located on the die holder 20. As the die holder 20 turns, a vacuum though the air orifices causes the material to be held dose to the die holder 20 as material is brought into contact with the die pattern 30. After contact with the die pattern 30, the vacuum is released and pressurized air typically blown through the air orifices to facilitate the release of the material from the die holder 20. The pop-up cut out shapes 46 facilitate the expulsion of the material from the die holder 20 and permit the continued use of the pressurized air through the air offices, thereby increasing the efficiency of the material removal from the die holder 20.

Thus, a waste repellent system for use in remove scrap material from cutting die systems is provided which attain the aforenoted objects. Further, the die holder has been described to include either magnetized or non-magnetized means for holding the cutting die plate in position. Although the structure and operation of the apparatus has been described in connection with the cutting of paper-like material, it is not intended that the invention be limited only to such operations. Various additional modifications of the described embodiments of the invention specifically illustrated and described herein will be apparent to those skilled in the art, particularly in light of the teachings of this invention. The invention may be utilized in the formation of any pattern in any thin and flexible sheet-like material, including, for example, paper, cloth or plastic materials to form envelopes, labels, sanitary napkins, window patterns and the like. It is intended that the invention cover all modifications and embodiments which fall within the spirit and scope of the invention. Thus, while preferred embodiments of the present invention have been disclosed, it will be appreciated that it is not limited thereto but may be otherwise embodied within the scope of the following claims.

What is claimed is:

1. A waste repellent system for use in removing scrap material from a cutting die, said system comprising:

a cylindrical die holder for rotation about an axis;

a flexible cutting die plate, said flexible cutting die plate comprising:

a substantially flexible sheet-like material having a sheet surface defined by leading, trailing and opposing side edges, a pattern surface having leading and side impression surfaces raised to a predetermined height above the sheet surface said impression surfaces defining an impression area for cutting a pattern into a web or blank, said impression area comprising a plurality of push pattern projections formed within and of said sheet like material at predetermined locations of said area, such that said pop-up push patterns are bendable into being coplanar with said sheet-like material and biased away from said impression surface for repelling scrap material from said cutting, die plate.

2. The system as in claim 1, wherein said cutting die plate is further comprised of an alignment means which cooperates with the die holder for accurately aligning said cutting die plate.

3. The system as in claim 1, wherein the pattern surface area is a rectangle.

4. The system as in claim 1, wherein the push pattern projections comprise semi-circle cut-outs.

5. The system as in claim 1, wherein the push pattern projections comprise horseshoe shaped cut-outs.

6. The system as in claim 1, wherein said push pattern projections for repelling waste are formed at predetermined locations of said flexible cutting die plate that are outside said area.

7. The system as in claim 1, wherein said cutting die plate is further comprised of orifices for communicating pressurized air located upon said pattern surface area.

8. The system as in claim 7, wherein said push pattern projections are substantially aligned with said orifices.

9. The system as in claim 1, wherein said holder is characterized as a magnetic holder.

10. The system as in claim 1, wherein said system is further comprised of means for blowing said scrap away from the cutting die plate.

11. The system as in claim 1, further characterized by said die holder rotation creating centrifugal force that correspondingly maximizes said push pattern projection scrap repelling force by bending said push pattern projections away from said die plate surface.

12. The system as in claim 1, wherein said holder is characterized as a non-magnetic holder.

13. A method for removing scrap material from a flexible cutting die plate which is positioned on a rotary die holder cooperating with an anvil, said method comprising the steps of:

affixing the flexible cutting die plate to the rotary die holder, said flexible cutting die plate comprising an impression surface, said impression surface having a pattern surface area comprising bendable push pattern projections that are formed in and of said flexible die plate, such that said pop-up push patterns are bendable into being coplanar with said cutting die plate and biased away from the impression surface for repelling scrap material from said cutting die plate;

rotating the die holder thereby causing said bendable push pattern projections to bendably extend and push said scrap material from the flexible cutting die plate.

14. The method as set forth by claim 13, further including the step of having pressurized air pass through orifices located in said pattern surface thereby further repelling scrap material.

* * * * *